US007395009B2

(12) United States Patent
Inoue

(10) Patent No.: US 7,395,009 B2
(45) Date of Patent: Jul. 1, 2008

(54) SHEET CARRIER APPARATUS, IMAGE FORMING APPARATUS, IMAGE READER, AND POST-PROCESSING APPARATUS

(75) Inventor: Nobuo Inoue, Chiba (JP)

(73) Assignee: Ricoh Company, Limited, Tokyo (JP)

( * ) Notice: Subject to any disclaimer, the term of this patent is extended or adjusted under 35 U.S.C. 154(b) by 387 days.

(21) Appl. No.: 11/074,780

(22) Filed: Mar. 9, 2005

(65) Prior Publication Data

US 2005/0201790 A1 Sep. 15, 2005

(30) Foreign Application Priority Data

Mar. 9, 2004 (JP) ..... 2004-065364
Sep. 13, 2004 (JP) ..... 2004-265959
Nov. 10, 2004 (JP) ..... 2004-326972

(51) Int. Cl.
*G03G 21/00* (2006.01)
*B41J 29/17* (2006.01)

(52) U.S. Cl. ..... 399/123; 399/34; 101/423

(58) Field of Classification Search ..... None
See application file for complete search history.

(56) References Cited

U.S. PATENT DOCUMENTS 4,706,320 A * 11/1987 Swift ..... 15/1.51
5,021,837 A * 6/1991 Uto et al. ..... 399/405
2001/0031154 A1 10/2001 Sato et al.

FOREIGN PATENT DOCUMENTS

| | | | |
|---|---|---|---|
| JP | 01184177 A | * | 7/1989 |
| JP | 02016074 A | * | 1/1990 |
| JP | 2-188332 | | 7/1990 |
| JP | 03038793 A | * | 2/1991 |
| JP | 04195080 A | * | 7/1992 |
| JP | 5-53486 | | 3/1993 |
| JP | 7-215523 | | 8/1995 |
| JP | 09034288 A | * | 2/1997 |
| JP | 11-59945 | | 3/1999 |

* cited by examiner

*Primary Examiner*—Daniel J. Colilla
*Assistant Examiner*—'Wynn' Q Ha
(74) *Attorney, Agent, or Firm*—Oblon, Spivak, McClelland, Maier & Neustadt, P.C.

(57) ABSTRACT

A sheet carrier apparatus includes a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening. In the sheet carrier apparatus, the paper-dust removal member includes a first part and a second part that are arranged along the second direction, and the first part and the second part have a different contact resistance against the sheet.

15 Claims, 7 Drawing Sheets

SHEET CARRIER APPARATUS, IMAGE FORMING APPARATUS, IMAGE READER, AND POST-PROCESSING APPARATUS

CROSS-REFERENCE TO RELATED APPLICATIONS

The present document incorporates by reference the entire contents of Japanese priority documents, 2004-065364 filed in Japan on Mar. 9, 2004, 2004-265959 filed in Japan on Sep. 13, 2004, and 2004-326972 filed in Japan on Nov. 10, 2004.

BACKGROUND OF THE INVENTION

1) Field of the Invention

The present invention relates to a sheet carrier apparatus in an image forming apparatus.

2) Description of the Related Art

In general, an image forming apparatuses such as a copying machine includes a sheet carrier apparatus or the like. Some sheet carrier apparatuses include a carrier guide, and carry a sheet by sliding the sheet on the carrier guide.

Recently, resources saving and cost control have been required and the image forming apparatus comes to form an image on a backing paper, which has an image on a back side, or a recycled paper.

However, several problems occur when the backing paper or the recycled paper are used. For example, such papers tend to produce paper dust during a transport process, and the paper dust accumulates on the carrier guide. Particularly, when the carrier guide has a curved portion, the sheet bumps or rubs against the carrier guide, or is bent due to the curved portion. Therefore, the amount of the paper dust increases.

When the paper dust accumulates on the carrier guide, the paper dust adheres to the sheet again while the sheet is being carried, and a coefficient of friction of a carrier roller pair decreases. Consequently, the sheet is not carried correctly.

In the case of the image forming apparatus such as an electrophotographic image forming apparatus, if the paper dust adheres to the sheet again during transportation of the sheet, and enters into a printer engine, the paper dust may adhere to an image carrier (a photoconductor or an intermediate transfer belt). Moreover, a cleaning apparatus, which is arranged near the image carrier, may fail to remove the paper dust completely. Consequently, the image forming apparatus forms abnormal images, such as an image that has black lines and white lines, or an image that has white spots and black spots.

Japanese Patent Application Laid-open No. H7-215523 discloses a carrier guide that includes a hole through which the paper dust falls while the sheet is being carried. However, some paper dust still remains on the sheet, and such paper dust may drop or accumulate in other transport paths undesirably. Consequently, the paper dust is built up inside the image forming apparatus, and an increase of skew or slip ratio deteriorates transport performance.

SUMMARY OF THE INVENTION

It is an object of the present invention to solve at least the above problems in the conventional technology.

According to one aspect of the present invention, a sheet carrier apparatus includes a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening. In the sheet carrier apparatus, the paper-dust removal member includes a first part and a second part that are arranged along the second direction, and the first part and the second part have a different contact resistance against the sheet.

According to another aspect of the present invention, an image forming apparatus includes a sheet carrier apparatus that includes a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening, wherein the paper-dust removal member includes a first part and a second part that are arranged along the second direction, and the first part and the second part have a different contact resistance against the sheet; and a printer engine that forms an image the sheet.

According to still another aspect of the present invention, an image reader includes a sheet carrier apparatus that includes a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening, wherein the paper-dust removal member includes a first part and a second part that are arranged along the second direction, and the first part and the second part have a different contact resistance against the sheet; and an optical reader that reads reflected light of light that is irradiated onto a surface of the sheet, wherein the surface has an image.

According to still another aspect of the present invention, a post processing apparatus includes a sheet carrier apparatus that includes a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening, wherein the paper-dust removal member includes a first part and a second part that are arranged along the second direction, and the first part and the second part have a different contact resistance against the sheet; and a post processing unit that performs post processing to the sheet.

The other objects, features, and advantages of the present invention are specifically set forth in or will become apparent from the following detailed description of the invention when read in conjunction with the accompanying drawings.

DETAILED DESCRIPTION

Exemplary embodiment of the present invention will be explained with reference to the accompanying drawings.

Figure 1:
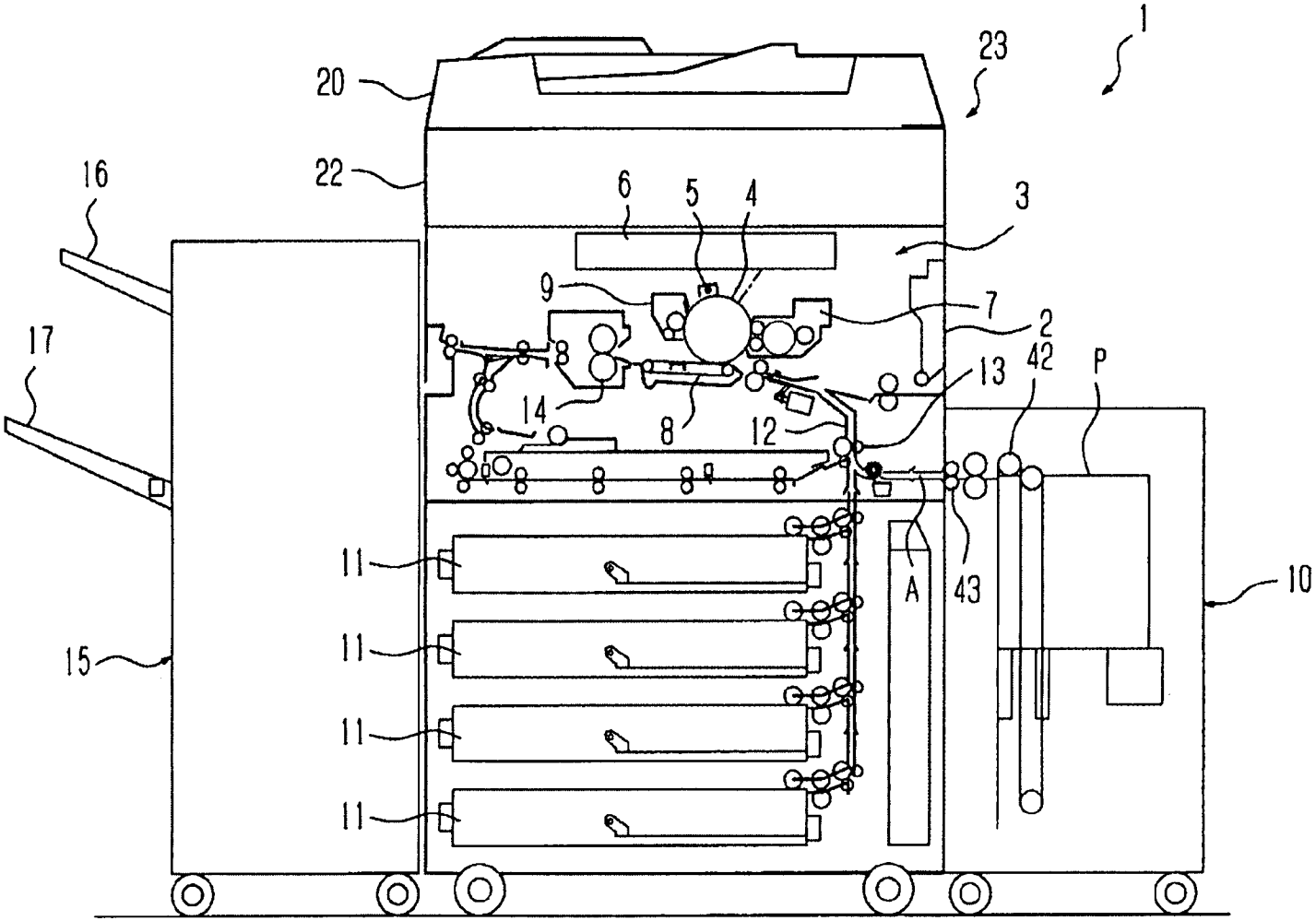
FIG. 1 is a side view of an image forming apparatus according to a first embodiment of the present invention.
Figure 2:
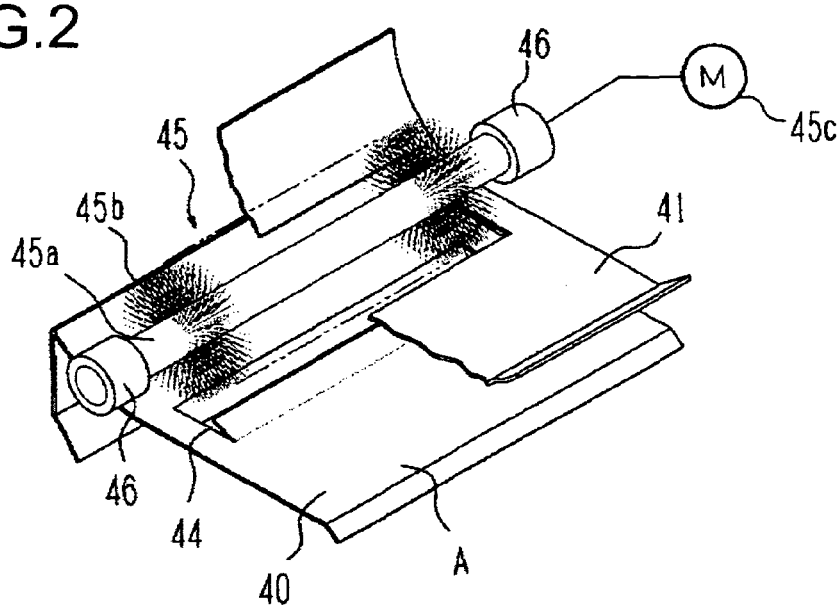
FIG. 2 is a perspective view of a sheet carrier shown in FIG. 1.
Figure 3:
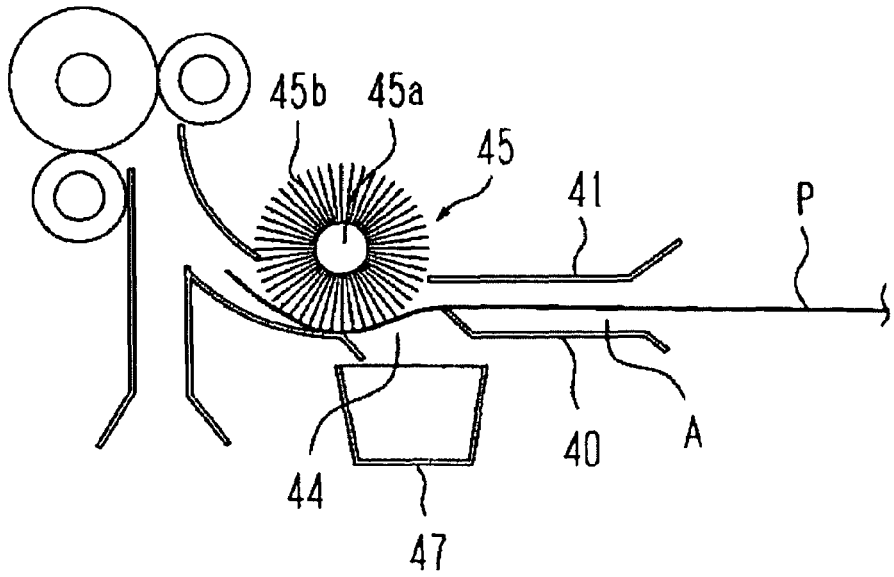
FIG. 3 is a side view of the sheet carrier shown in FIG. 2.
Figure 4:
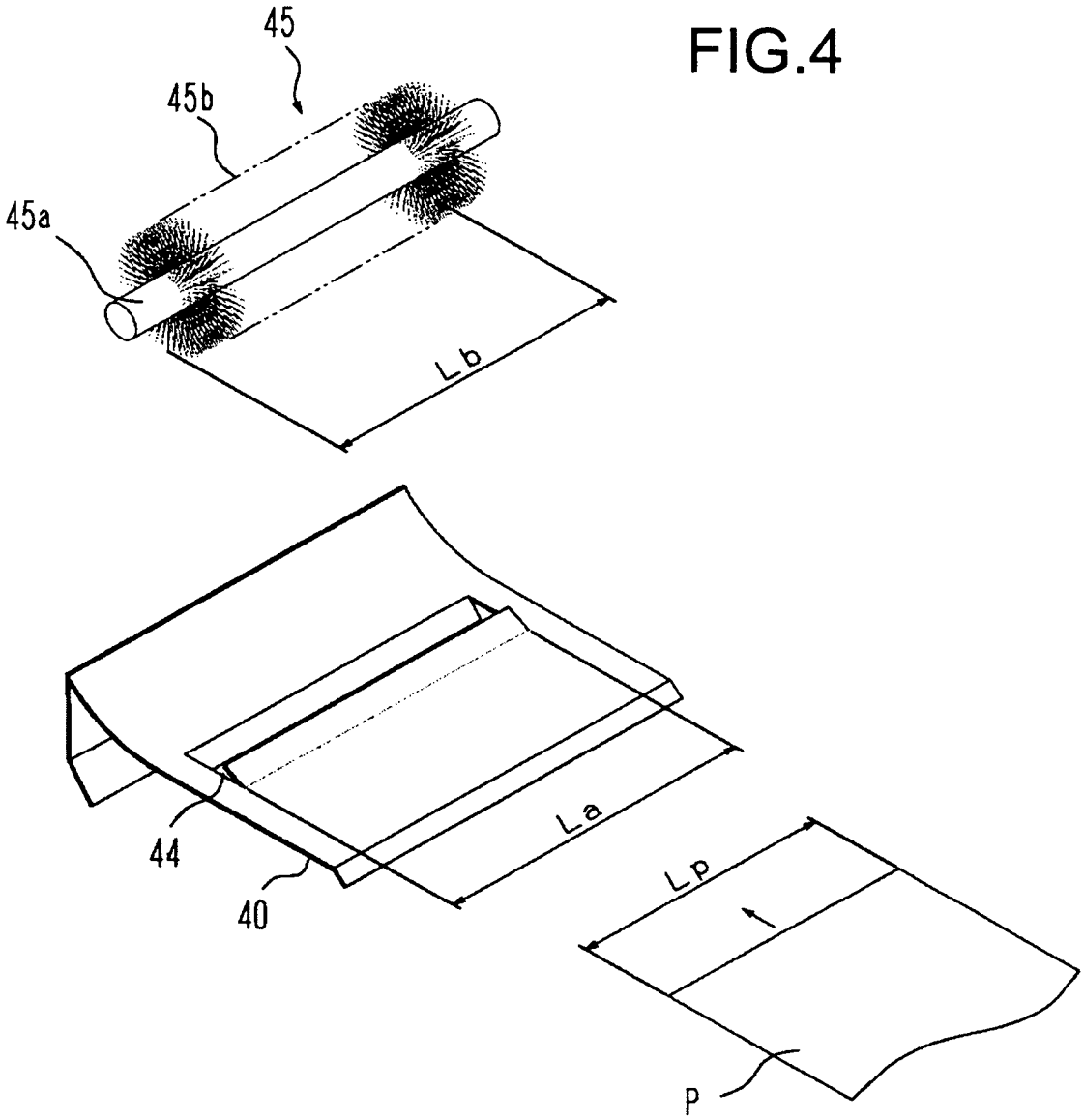
FIG. 4 is an exploded perspective view of the sheet carrier shown in FIG. 2.
Figure 5:
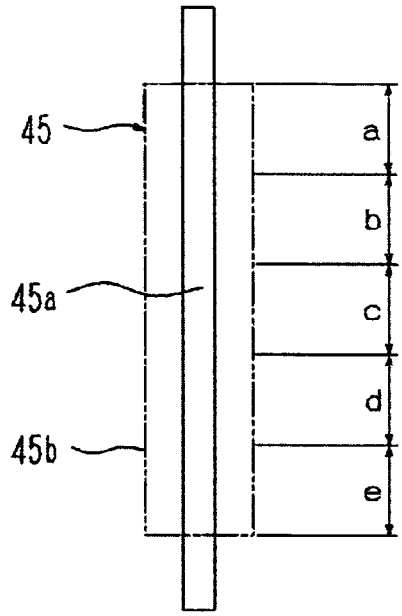
FIG. 5 is a plan view of a brush-like member shown in FIG. 2.
Figure 6:
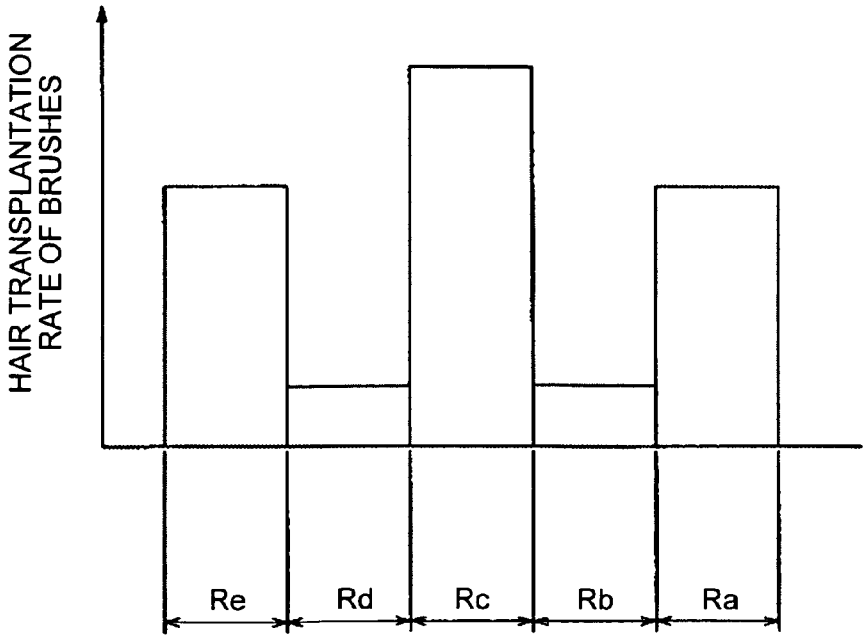
FIG. 6 is a distribution chart of a hair transplantation rate of the brush-like member shown in FIG. 2.
Figure 7:
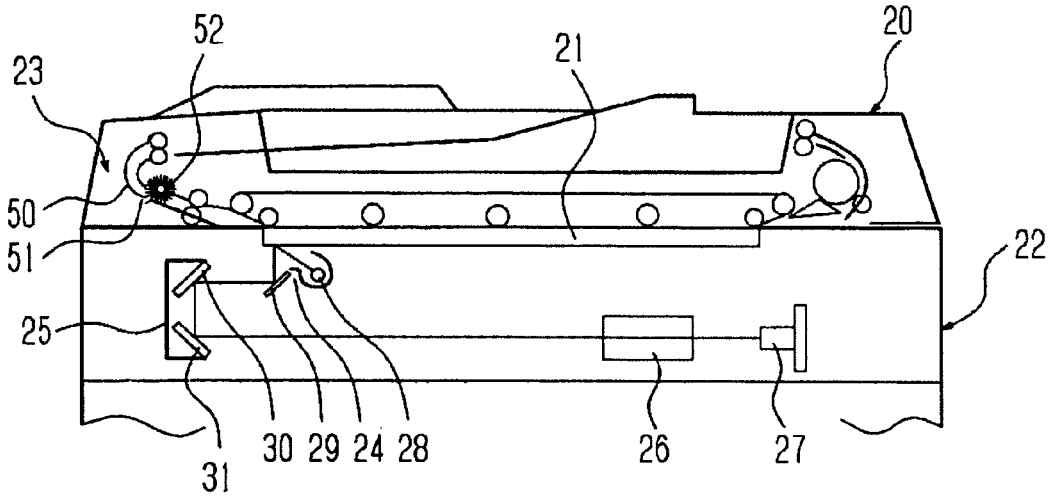
FIG. 7 is a side view of an image reader in the copying machine shown in FIG. 1.
Figure 8:
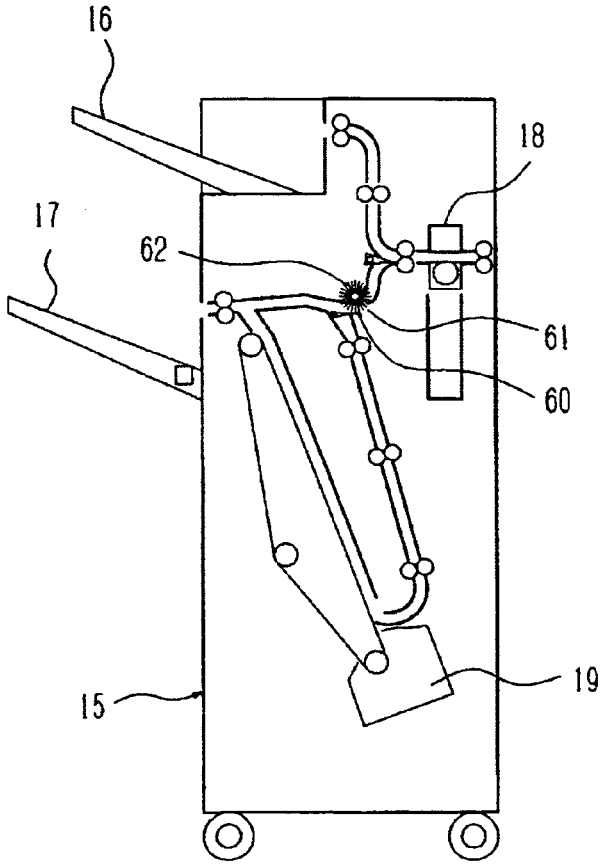
FIG. 8 is a side view of a post processing apparatus in the copying machine shown in FIG. 1.

A first embodiment of the present invention will be explained with reference to FIGS. 1 to 8. FIG. 1 is a side view of a copying machine, which is an image forming apparatus; FIG. 2 is a perspective view of the sheet carrier; FIG. 3 is a side view of the sheet carrier; FIG. 4 is an exploded perspective view of the sheet carrier; FIG. 5 is a plan view of a brush-like member; FIG. 6 is a distribution chart of a hair transplantation rate of the brush-like member; FIG. 7 is a side view of an image reader in the copying machine; and FIG. 8 is a side view of a post processing apparatus in the copying machine.

A main unit 2 of a copying machine 1, which is an image forming apparatus, includes a printer engine 3 that forms a toner image according to an electrophotographic process. The printer engine 3 includes a drum-like image carrier (photoconductor) 4, a charger 5 that uniformly charges the outer circumferential surface of the photoconductor 4, an exposure unit 6 that exposes the outer circumferential surface of the photoconductor 4 charged by the charger 5 based on image data, and forms an electrostatic latent image, a developing unit 7 that provides a toner to the electrostatic latent image and develops the electrostatic latent image into a toner image, a transfer and carrier unit 8 that transfers the developed toner image onto a sheet material P and carries the sheet material P, and a cleaning unit 9 that removes the residual toner on the photoconductor 4 after the transfer. The exposure unit 6 uses laser beams, and includes a light source, such as a laser diode, a polygon mirror that allows the laser beam to scan, a polygon motor, an fθ lens, and a mirror.

The main unit 2 includes a transport route 12. A paper feed cassette 11, and a large-capacity paper feeder 10 is externally attached to the main unit 2. The sheet material P is provided from a large-capacity paper feeder 10 or the paper feed cassette 11, and carried on the transport route 12. On the transport route 12, a carrier roller pair 13 that carries the sheet material P, the printer engine 3, and a fixing unit 14 that fixes the toner image transferred onto the sheet material P are provided.

A post processing unit 15 is mounted on the main unit 2, and performs the post processing to the sheet material P after the fixing unit 14 performs the fixing process to the sheet material P. The post processing unit 15 has a fixed tray 16, a movable tray 17, a paper reversing-and-ejecting unit that reverses the sheet material P ejected from the main unit 2 and ejects the sheet onto the fixed tray 16, a punching unit 18 that punches the sheet material P, and a stapler 19 that stacks and staples a plurality of sheet materials P.

An image reader 23 is arranges above the main unit 2, and includes an auto document feeder 20 (hereinafter, "ADF 20"), a contact glass 21, and an optical reader 22. The auto document feeder (ADF) 20 automatically feeds original document to be read, the document to be read is placed on the contact glass 21, and the optical reader 22 reads the document automatically fed by the ADF 20 or the document placed on the contact glass 21.

The optical reader 22 includes first and second traveling bodies 24 and 25 that travel at a speed of 2:1 parallel to the contact glass 21, a lens 26, and a photoelectric transducer 27 (, hereinafter "CCD 27"). A light source 28 and a first mirror 29 are mounted on the first traveling unit 24. The light source 28 illuminates the document placed on the contact glass 21 or the document carried by the ADF 20, and the first mirror 29 reflects the light reflected by the document. A second mirror 30 and a third mirror 31 are mounted on the second traveling unit 25, and reflect the light reflected by the first mirror 29. The lens 26 and the CCD 27 are arranged ahead of the traveling direction of the light sequentially reflected by the first to third mirrors 29, 30, and 31.

In the above configuration, the copying machine 1 forms an image as described below.

The optical reader 22 reads an image of the document placed on the contact glass 21 or an image automatically fed by the ADF 20. A semiconductor laser in the exposure unit 6 emits laser beams corresponding to the image data based on the read result. The laser beams expose the outer circumference surface of the photoconductor 4 that is uniformly charged by the charger 5, and an electrostatic latent image is thereby formed. The developing unit 7 supplies the toner to the electrostatic latent image. Consequently, the electrostatic latent image is developed and a toner image is formed.

On the other hand, after the optical reader 22 starts to read the image, the sheet material P is supplied from the large-capacity paper feeder 10 or the paper feed cassettes 11, and is carried on the transport route 12. When the sheet material P passes through a portion where the photoconductor 4 and the transfer-and-carrier unit 8 abut each other, the toner image is transferred onto the sheet material P.

Then, the transfer-and-carrier unit 8 carries the sheet material P to the fixing unit 14, the fixing unit 14 performs the fixing processing to the sheet material P, and the sheet material P is carried to the post processing unit 15. Subsequently, the sheet material P is directly ejected onto the fixed tray 16, or a punching unit 18 and a stapler 19 (see FIG. 8) perform various types of post processing to the sheet material P.

As shown in FIGS. 2 and 3, a carrier path A is formed such that a lower-sheet carrier guide 40 and an upper-sheet carrier guide 41 face each other, and the sheet material P is supplied from the large-capacity paper feeder 10 to the main unit 2 through the carrier path A. A separating/paper feeding roller 42, which is a separating/paper feeding member, rotates and separates the sheet material P loaded in the large-capacity paper feeder 10 one by one, and a carrier roller part 43 carries the sheet material P onto the lower-sheet carrier guide 40.

An opening 44 is formed in the lower-sheet carrier guide 40. The opening 44 has a long shape that extends in the direction orthogonal to the transport direction of the sheet material P. Above the opening 44, a brush-like member 45, which is a paper-dust removal member, is rotatably arranged along on the axis that extends in the direction orthogonal to the transport direction of the sheet material P. The brush-like member 45 includes a columnar shaft 45*a* and a brush 45*b* that is radially provided on the outer circumferential surface of the shaft 45*a*. The hair of the brush 45*b* is directly transplanted on the outer circumferential surface of the shaft 45*a*. A holding unit 46 rotatably holds the brush-like member 45, and is mounted on both ends of the shaft 45*a*. A motor 45*c* drives the brush-like member 45 to rotate on the axis of the shaft 45*a*, and is connected to one of the ends of the shaft 45*a*. The brush-like member 45 is arranged such that the head of the brush 45*b* makes a contact with the surface of the lower-sheet carrier guide 40.

Therefore, when the sheet material P is carried on the lower-sheet carrier guide 40, the motor 45*c* drives the brush-like member 45, whose head makes a contact with the surface of the sheet material P, to rotate on the axis of the shaft 45*a*. The brush-like member 45 is driven so as to rotate the brush 45*b* in an opposite direction (counter direction) to the traveling direction of the sheet material P, at a portion where the brush-like member 45 makes a contact with the sheet material P. Therefore, the brush-like member 45 removes the paper dust that adheres to the sheet material P when the brush-like member 45 rotates. After the sheet material P passes above the opening 44, the paper dust removed from the sheet material P falls through the opening 44. Then the paper dust is stored in a paper dust box 47 arranged below the opening 44.

When a force Fp is a minimum sheet driving force Fp when the sheet material P carried on the lower-sheet carrier guide 40 makes a contact with the brush 45*b* of the brush-like member 45, and a resistance Rb is a maximum transport resistance Rb applied to the sheet material P by the brush-like member 45, the relation between the force Fp and the resistance Rb is always set to satisfy Fp>Rb. Therefore, when the sheet material P makes a contact with the brush 45*b* of the brush-like member 45, the sheet material P travels while rotating the brush-like member 45.

The length of the opening 44 in the longitudinal direction (a direction orthogonal to the transport direction of the sheet material P) is set to La, and the length of the brush-like member 45 in the extending direction (a direction orthogonal to the transport direction of the sheet material P) is set to Lb. The sheet material P carried on the lower-sheet carrier guide 40 has a maximum sheet width Lp in the direction orthogonal to the transport direction of the sheet material P. The lengths La and Lb, and the maximum sheet width Lp are set to satisfy $Lp<Lb\leqq La$. Accordingly, the brush-like member 45 removes the paper dust with respect to the sheet material P of all sizes, and the paper dust falls through the opening 44 without remaining on the lower-sheet carrier guide 40.

The hair transplantation rate of the brush 45*b* indicates the number of hair transplantation of the brush 45*b* per unit area, and is partially different at positions along the axial direction of the shaft 45*a* of the brush-like member 45. Specifically, as shown in FIGS. 5 and 6, an area Rc, which is centered in the axial direction of the shaft 45*b*, has the highest hair transplantation rate, and areas Ra and Re, which are located at both ends, have the second highest one, and areas Rb and Rd, which are respectively between the areas Ra and Rc, and areas Rc and Re, have the lowest one. The area Rc is a part opposite to the area against which the separating/paper feeding roller 42 is pressed. The sheet material P is most likely to have the paper dust at the area Rc since the separating/paper feeding roller 42 is pressed against the area Rc. The areas Ra and Re are corresponding to both ends of the sheet material P in the transport direction of the sheet material P. The sheet material P is likely to have the paper dust at the both ends since the sheet material P makes a contact with the peripheral guide members while the sheet material P is being carried. The sheet material P is most unlikely to have the paper dust at the part facing the areas Rb and Rd while the paper material is being carried on the lower-sheet carrier guide 40.

In this manner, since the hair transplantation rate of the brush 45*b* is partially different at positions along the axial direction of the brush-like member 45, and the hair transplantation rate of the brush 45*b* is increased in the area opposite to the part where the sheet material P is likely to have the paper dust, the paper dust is remove from the sheet material P efficiently. Moreover, although a transport resistance is caused by a contact with the sheet material P, the transport resistance decreases by reducing the hair transplantation rate of the brush 45*b* in the area opposite to the part where the sheet material P is unlikely to have the paper dust. As a result, even when the sheet material P is thin or of low quality, the transport performance of the sheet material P is maintained, and the sheet material P is prevented from bending, being turned up, or being unfed.

The brush-like member 45 is formed of an electroconductive material, an antistatic material, or a material subjected to an antistatic treatment. When the brush-like member 45 is formed of the electroconductive material, the holding unit 46 is also formed of the electroconductive material. When the brush-like member 45 is formed of the electroconductive material, electricity is removed from the sheet material P when the brush-like member makes a contact with the sheet material P, and it is thereby prevented that the paper dust adheres to the sheet material P due to static electricity. When the brush-like member 45 is formed of the antistatic material or is subjected to the antistatic treatment, it is prevented that the paper dust adheres to the brush-like member 45 due to the static electricity charged in the brush-like member 45.

FIG. 7 is a side view of the image reader 23 in the copying machine 1. The image reader 23 also includes the sheet carrier unit that removes the paper dust that adheres to the sheet material (document). The sheet carrier unit includes a lower-sheet carrier guide 50, on which the document is carried, an opening 51, which is formed in the lower-sheet carrier guide 50, and a brush-like member 52, which is arranged above the opening 51 and corresponds to a paper-dust removal member that rotates on the axis. The opening 51, the brush-like member 52, and the paper dust box (not shown), which receives the paper dust that falls through the opening 51, respectively have the same configuration as the opening 44, the brush-like member 45, and the paper dust box 47.

In the image reader 23, the optical reader 22 reads an image of the document, from which the paper dust is removed. Consequently, the high quality of the read image is obtained without being affected by the paper dust.

FIG. 8 is a side view of the post processing unit 15 in the copying machine 1. The post processing unit 15 also includes the sheet carrier unit that removes the paper dust that adheres to the sheet material. The sheet carrier unit includes a lower-sheet carrier guide 60, on which the sheet material that has the fixed toner image is carried, an opening 61, which is formed in the lower-sheet carrier guide 60, and a brush-like member 62, which is arranged above the opening 61 and corresponds to the paper-dust removal member that rotates on the axis. The opening 61, the brush-like member 62, and the paper dust box (not shown), which receives the paper dust that falls through the opening 61, have the same configuration as the opening 44, the brush-like member 45, and the paper dust box 47, respectively.

In the post processing unit 15, post processing is performed to the sheet material from which the paper dust is removed, without being affected by the paper dust.

The second embodiment of the present invention will be explained with reference to FIGS. 9 to 12. When the elements are the same as the elements that are explained in FIGS. 1 to 8, the same references are applied to the elements, and explanation of the elements is omitted.

The sheet carrier unit according to the second embodiment has the basically same configuration as the sheet carrier unit according to the first embodiment, and includes the lower-sheet carrier guide 40 and the upper-sheet carrier guide 41 that face each other, and the opening 40, which is formed in the lower-sheet carrier guide 40 (see FIGS. 2 and 3).

Figure 9:
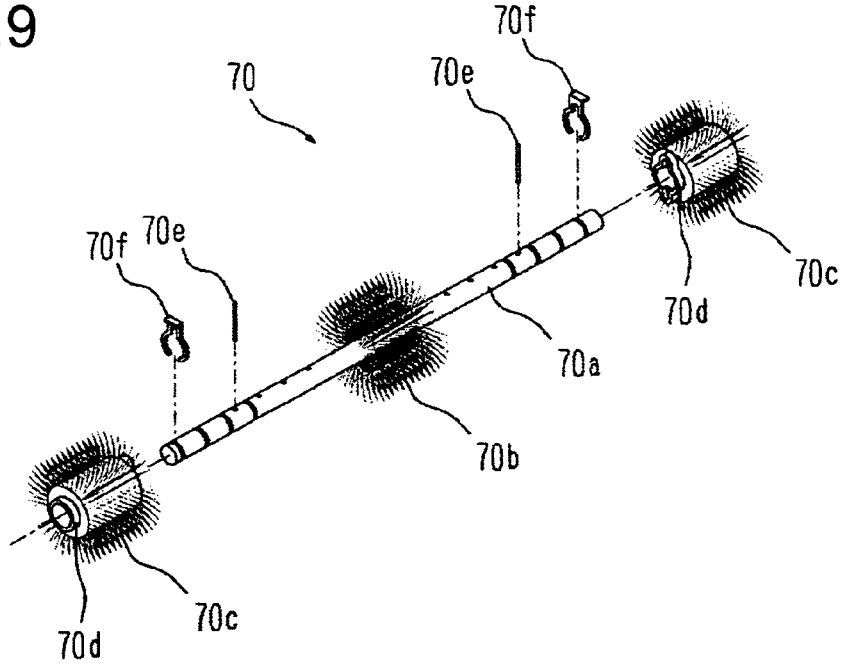
FIG. 9 is an exploded perspective view of a brush-like member according to a second embodiment of the present invention.

FIG. 9 is an exploded perspective view of a brush-like member 70, which is a paper-dust removal member. The brush-like member 70 is arranged above the opening 44, and rotates on an axis that extends in a direction orthogonal to the transport direction of the sheet material P. The brush-like member 70 includes a columnar shaft 70*a*, and brushes 70*b* and 70*c* that are radially provided on the outer circumferential surface of the shaft 70*a*. The hair of the brush 70*b* is directly transplanted on the outer circumferential surface of the shaft 70*a*. The hair of the brushes 70*c* is transplanted on the outer circumferential surface of a cylindrical member 70*d*, which is engaged with the shaft 70*a* so as to adjust the position along the axial direction of the shaft 70*a*.

The shaft 70*a* penetrates the cylindrical member 70*d* while supporting the cylindrical member 70*d*. A pin 70*e* prevents the cylindrical member 70*d* from rotating, and a retaining ring 7*f* fixes the cylindrical member 70*d* in the axial direction of the shaft 70*a*. The position of the cylindrical member 70*d* is shifted by changing each position of the pin 70*e* and the retaining ring 70*f*.

In other words, the cylindrical member 70*d* is a hollow body, and has inner diameter that engages with the outer diameter of the shaft 70*a*, which is a shaft member. When the shaft 70*a* is inserted into the hollow body from the axial direction, the pin 70*e* is detachably inserted into a hole provided in the outer surface of the shaft 70*a* so as to fix the cylindrical member 70*d*. The cylindrical member 70*d* is fixed to the shaft 70*a* in the axial direction by detachably locking the retaining ring 70*f* in a groove provided on the outer surface of the shaft 70*a*.

The brush 70*c* is supported by the cylindrical member 70*d*, and is detachably arranged so as to change the axial position with respect to the shaft 70*a*. The brush 70*b* is positioned in the center and fixed to the shaft 70*a*.

The brush-like member 70 is arranged such that the head of the brushes 70*b* and 70*c* make a contact with the surface of the lower-sheet carrier guide 40 (see FIGS. 2 and 3).

When the sheet material P is carried on the lower-sheet carrier guide 40, the brush-like member 70 makes a contact with the surface of the sheet material P at the head of the brushes 70*b* and 70*c*, and the motor 45*c* rotates the brush-like member 70 on the axis of the shaft 70*a*. Since the brush-like member 70 rotates on the axis of the shaft 70*a*, paper dust that adheres to the sheet material P is removed. Then, after the sheet material P passes above the opening 44, the paper dust falls through the opening 44. Subsequently, the paper dust is stored in the paper dust box 47 that is arranged below the opening 44.

Figure 10:
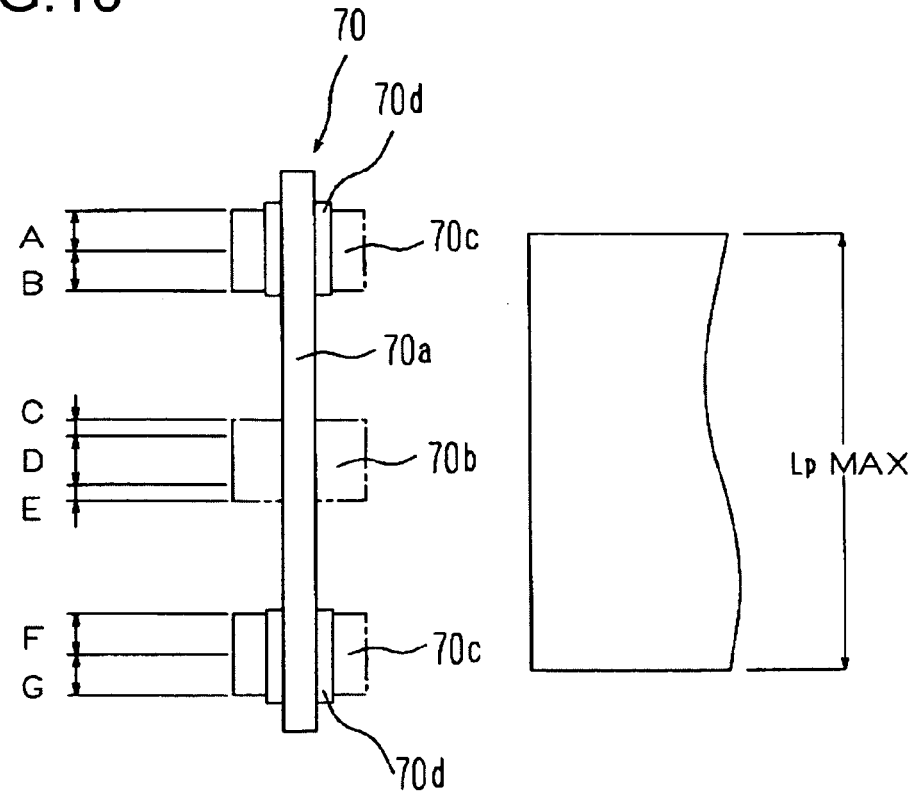
FIG. 10 is a plan view of the brush-like member shown in FIG. 9 and a sheet material.
Figure 11:
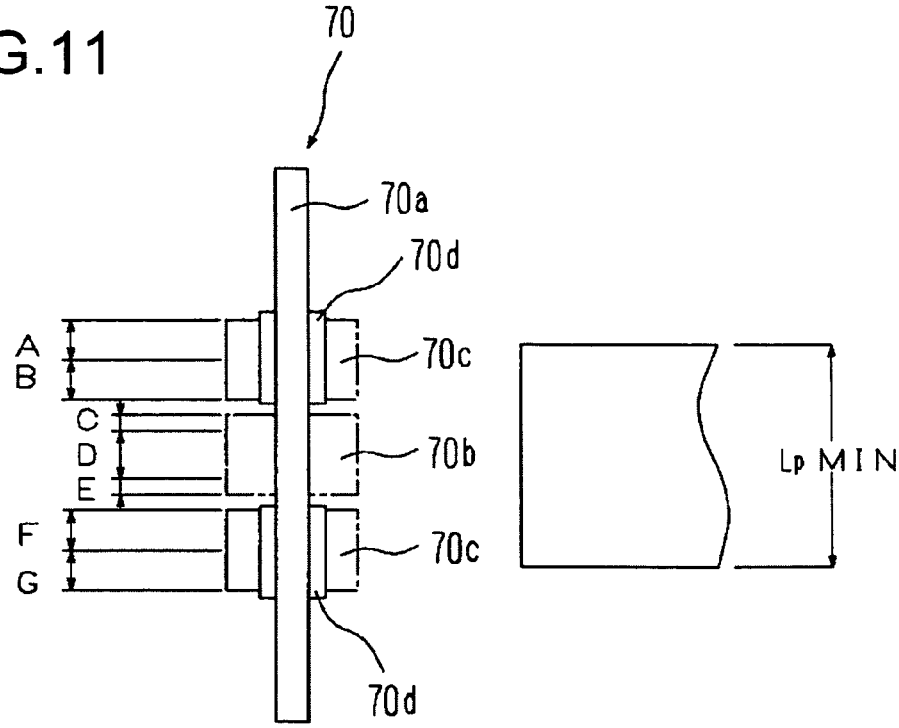
FIG. 11 is a plan view of the brush-like member shown in FIG. 9 and another sheet material.
Figure 12:
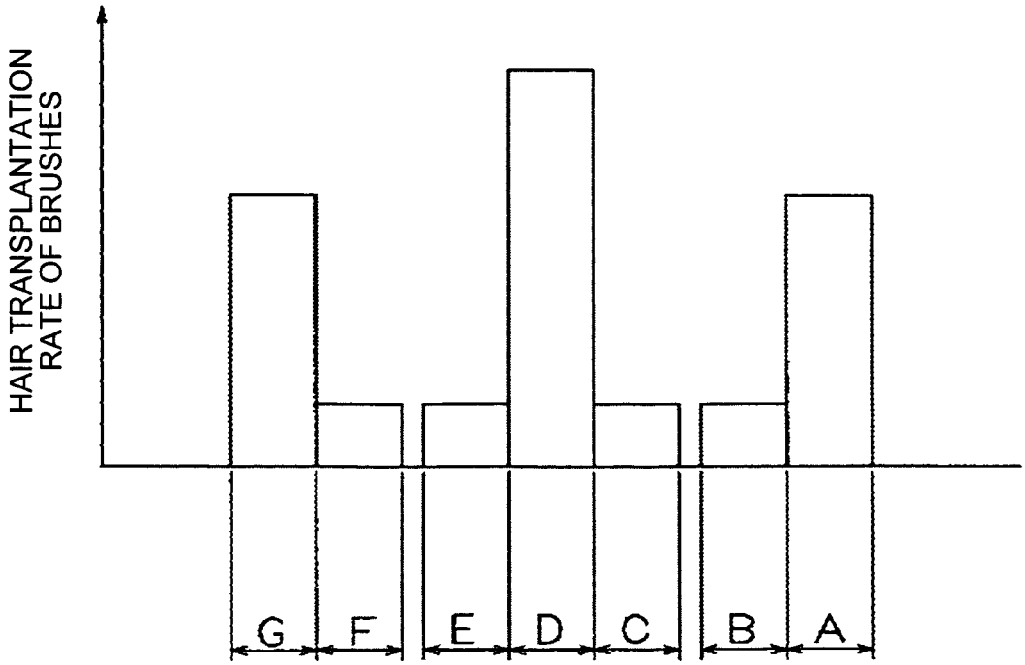
FIG. 12 is a distribution chart of the hair transplantation rate of the brush-like member shown in FIG. 9.

FIG. 10 is a plan view of the brush-like member 70 and a sheet material P that has the maximum width; FIG. 11 is a plan view of the brush-like member 70 and a sheet material P that has the minimum width; and FIG. 12 is a distribution chart of the hair transplantation rate of the brushes 70*b* and 70*c* shown in FIG. 11.

The hair transplantation rate of the brushes 70*b* and 70*c* is different partially at positions along the axial direction of the shaft 70*a* of the brush-like member 70. Specifically, as shown in FIGS. 10 to 12, an area D, which is centered in the axial direction of the shaft 70*a*, have the highest hair transplantation rate, areas A and G, which are located at both ends, have the second highest one, and the other areas B, C, E, and F have the lowest one.

The area D is a part corresponding to the area against which the separating/paper feeding roller 42 is pressed. The sheet material P is most likely have the paper dust at the area D because the separating/paper feeding roller 42 is pressed against the area D. The areas A and G are parts that face both ends of the paper material P in the transport direction of the paper material P carried on the lower-sheet carrier guide 40. The sheet material P is most likely have the paper dust at the both opposite in the transport direction, because the sheet material makes a contact with the peripheral guide members while the sheet material P is being carried. The sheet material P is most unlikely to have the paper dust at the parts facing the areas B, C, E, and F while the sheet material P is being carried on the lower-sheet carrier guide 40.

The positions of the areas A and G are adjustable by moving and fixing the positions selectively so as to correspond to the size of the sheet material P. When the size of the sheet material P is different, the positions of the both ends of the sheet material P are thereby different. Therefore, in order to correspond to the different sizes, the positions of the areas A and G are adjusted and changed.

The adjustable range is from the maximum size LpMAX, shown in FIG. 10, to the minimum size LpMIN, shown in FIG. 11, in a direction orthogonal to the transport direction of the sheet material P.

The sheet material P is most unlikely to have the paper dust at the parts that face the areas B, C, E, and F. Therefore, the hair transplantation rate may be low.

In this manner, the paper dust is effectively removed from the sheet material P since the hair transplantation rate of the brushes 70*b* and 70*c* is partially different at positions along the axial direction of the shaft 70*a*. Further, the paper dust is effectively removed from the sheet material P since the positions are adjustable by selectively shifting and fixing the positions, and the hair transplantation of the brushes 70*b* and 70*c* thereby increases at the areas opposite to the parts where the sheet material P is likely to have the paper dust.

Moreover, although a transport resistance is caused due to a contact with the sheet material P, the transport resistance with respect to the sheet material P decreases by reducing the hair transplantation rate of the brushes 70*b* and 70*c* in the areas opposite to the part where the sheet material P is unlikely to have the paper dust. As a result, even when the sheet material P is thin or of low quality, the transport performance of the sheet material P can be maintained, and the sheet material P is prevented from bending, being turned up, or being unfed.

The sheet carrier apparatus in this embodiment can be used in the image reader shown in FIG. 7 and in the post processing apparatus shown in FIG. 8.

According to the present invention, the paper-dust removal member effectively removes the paper dust that adheres to the sheet material while the sheet material is being carried on the lower sheet carrier guide. Moreover, although a transport resistance is caused when the paper-dust removal member makes a contact with the carried sheet material, the transport resistance that acts on the sheet material is kept low. Even when the sheet material is thin or of low quality, the transport performance of the sheet material is maintained, and the sheet material is prevented from bending, being turned up, or being unfed.

According to the present invention, since the head of the brush makes a contact with the sheet material while the sheet material is being carried, the paper dust that adheres to the sheet material is removed effectively. Moreover, since the head of the brush makes a contact with the sheet material, the transport resistance that acts on the sheet material by the brush-like member is kept low.

According to the present invention, since the brush-like member rotates on the axis of the shaft while the head of the brush makes a contact with the sheet material, the paper dust that adheres to the sheet material is removed effectively.

According to the present invention, on the sheet material, the paper dust is likely to be generated at an area against which the separating/paper feeding member is pressed, and at the both ends in the transport direction. However, by increasing the hair transplantation rate of the brush of the brush-like member in the parts corresponding to these areas, the paper dust is effectively removed from the sheet material. Further, since the parts that do not make a contact with such areas have the low hair transplantation rate, the transport resistance, which is caused by the contact of the brush with the sheet material, decreases as a whole. Consequently, even when the sheet material is thin or of low quality, the transport performance of the sheet material is maintained, and the sheet material is prevented from bending, being turned up, or being unfed.

According to the present invention, when the size of the sheet material is different, or when the positions where the sheet material is likely to have the paper dust is different, the positions of the parts where the hair transplantation rate of the brush is different is adjusted, and therefore, the hair transplantation rate of the part that faces the parts where the sheet material is likely to have the paper dust increases. Consequently, the paper dust that adheres to the sheet material is removed effectively.

According to the present invention, even when the size of the sheet material to be carried is different, by adjusting the positions of the parts, of the brush-like member, which the hair transplantation rate of the brush is high at, and faces the both ends in the transfer direction of the sheet material, the parts that have the high hair transplantation rate of the brush make a contact with the both ends of the sheet material that have various sizes. Consequently, the paper-dust removal performance is maintained.

According to the present invention, the paper dust is removed from the sheet material reliably, and then, the paper dust falls through the opening without remaining on the lower sheet carrier guide.

According to the present invention, the paper dust is removed by the brush-like member with respect to sheet materials of all sizes carried on the lower sheet carrier guide, and then, the paper dust falls through the opening.

According to the present invention, electricity is removed from the sheet material by the brush-like member, and it is thereby prevented that the paper dust adheres to the sheet material due to static electricity, and the brush-like member removes the paper dust from the sheet material with a higher performance.

According to the present invention, it is prevented that the paper dust adheres to the brush-like member due to the static electricity charged to the brush-like member, and therefore, the brush-like member removes the paper dust from the sheet material with a higher performance.

According to the present invention, the paper dust that falls through the opening is stored in the paper dust box, thereby scattering of the paper dust that falls through the opening is prevented.

According to the present invention, since the image forming apparatus includes the sheet carrier apparatus according to the present invention, the image forming apparatus forms an image using the printer engine on the sheet material from which the paper dust has been removed. Consequently, the quality of images formed on the sheet material improves.

According to the present invention, since the image reader includes the sheet carrier apparatus according to the present invention, the optical reader reads an image on the sheet material from which paper dust is removed. Consequently, the optical reader reads an image of the sheet material with a higher performance.

According to the present invention, since the post processing apparatus includes the sheet carrier apparatus according to the present invention, the post processing apparatus performs post processing with respect to the sheet material from which paper dust is removed, and therefore, the performance of post processing improves.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet carrier apparatus comprising:

a sheet carrier guide including a guiding surface configured to extend along a first direction to guide and support a sheet, the guiding surface including an opening therein; and a paper-dust removal member that is arranged substantially above the guiding surface with the opening therein and so as to make a contact with the sheet carried on the guiding surface of the sheet carrier guide, the paper-dust removal member extending in a second direction orthogonal to the first direction, and removes paper dust so that the paper dust falls through the opening, wherein the paper-dust removal member includes at least a first part centrally located between opposite ends of the paper-dust removal member and a second part located between the first centrally located part and at least one of the opposite ends of the paper-dust removal member, the first centrally located part and the second part being arranged along the second direction, and the centrally located first part having higher contact resistance against the sheet as compared to the contact resistance of the second part against the sheet.

2. The sheet carrier apparatus according to claim 1, wherein the paper-dust removal member is a brush member that has a shaft and a brush that is radially provided around the shaft.

3. The sheet carrier apparatus according to claim 2, further comprising an arrangement that rotatably hold the shaft.

4. A sheet carrier apparatus comprising:

a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening, wherein the paper-dust removal member is a brush member that has a shaft and a brush that is radially provided around the shaft that includes a first and a second part that are arranged along the second direction, and the first part and the second part have a different contact resistance against the sheet, the brush member further including a third part, a fourth part, and a fifth part, the fourth part and the fifth part are arranged at two ends of the brush member, the third part is pressed by a paper feeding member that feeds the sheet, the third part, the first part, and the second part are arranged in between the fourth part and the fifth part, and the third part, the fourth part, and the fifth part have a higher hair transplantation rate than the first and second parts.

5. A sheet carrier apparatus comprising:

a sheet carrier guide to guide a sheet in a first direction and includes an opening; and a paper-dust removal member that is arranged substantially above the opening and so as to make a contact with the sheet carried on the sheet carrier guide, is extending in a second direction orthogonal to the first direction, and removes paper dust so that the paper dust falls through the opening, wherein the paper-dust removal member is a brush member that has a shaft and a brush that is radially provided around the shaft that includes a first and a second part that are arranged along the second direction, and the first part and the second part have a different contact resistance against the sheet, a position of the first part is fixed and a position of the second part is adjustable in a direction of the axis of the shaft, and the first part and the second part have a different hair transplantation rate.

6. The sheet carrier apparatus according to claim 5, wherein the brush member further includes a third part, a fourth part and a fifth part, a position of the third part is adjustable in the direction of the axis of the shaft, the second part and the third part are arranged at two ends of the brush-like member, the first part is pressed by a paper feeding member that feeds the sheet, the first part and the fourth and fifth parts are arranged in between the second part and the third part, and the first part, the second part, and the third part have a higher hair transplantation rate than the fourth and fifth parts.

7. The sheet carrier apparatus according to claim 2, wherein the brush includes a head that makes a contact with the sheet carrier guide.

8. The sheet carrier apparatus according to claim 2, wherein the opening is a slit that extends in the second direction, and when a length of the slit is La, a length of the brush member in a direction along the axis of the shaft is Lb, and a maximum width of the sheet in the second direction is Lp, then $Lp<Lb\leqq La$.

9. The sheet carrier apparatus according to claim 2, wherein the brush member includes an electroconductive material.

10. The sheet carrier apparatus according to claim 2, wherein the brush-like member includes an antistatic material.

11. The sheet carrier apparatus according to claim 2, wherein the brush member is subjected to an antistatic treatment.

12. The sheet carrier apparatus according to claim 1, further comprising a paper dust box that is provided substantially below the opening, and receives the paper dust that falls through the opening.

13. An image forming apparatus comprising:

a sheet carrier apparatus that includes a sheet carrier guide including a guiding surface configured to extend along a first direction to guide and support a sheet, the guiding surface including an opening therein; and a paper-dust removal member that is arranged substantially above the guiding surface with the opening therein and so as to make a contact with the sheet carried on the guiding surface of the sheet carrier guide, the paper-dust removal member extending in a second direction orthogonal to the first direction, and removes paper dust so that the paper dust falls through the opening, wherein the paper-dust removal member includes at least a first part centrally located between opposite ends of the paper-dust removal member and a second part located between the first centrally located part and at least one of the opposite ends of the paper-dust removal member, the first centrally located part and the second part being arranged along the second direction, and the centrally located first part having a higher contact resistance against the sheet as compared to the contact resistance of the second part against the sheet; and a printer engine that forms an image on the sheet.

14. An image reader comprising:

a sheet carrier apparatus including a sheet carrier guide including a guiding surface configured to extend along a first direction to guide and support a sheet, the guiding surface including an opening therein; and a paper-dust removal member that is arranged substantially above the guiding surface with the opening therein and so as to make a contact with the sheet carried on the guiding surface of the sheet carrier guide, the paper-dust removal member extending in a second direction orthogonal to the first direction, and removes paper dust so that the paper dust falls through the opening, wherein the paper-dust removal member includes at least a first part centrally located between opposite ends of the paper-dust removal member and a second part located between the first centrally located part and at least one of the opposite ends of the paper-dust removal member, the first centrally located part and the second part being arranged along the second direction, and the centrally located first part having a higher contact resistance against the sheet as compared to the contact resistance of the second part against the sheet; and an optical reader that reads reflected light of light that is irradiated onto a surface of the sheet, wherein the surface has an image.

15. A post processing apparatus comprising:

a sheet carrier apparatus including a sheet carrier guide including a guiding surface configured to extend along a first direction to guide and support a sheet, the guiding surface including an opening therein; and a paper-dust removal member that is arranged substantially above the guiding surface with the opening therein and so as to make a contact with the sheet carried on the guiding surface of the sheet carrier guide, the paper-dust removal member extending in a second direction orthogonal to the first direction, and removes paper dust so that the paper dust falls through the opening, wherein the paper-dust removal member includes at least a first part centrally located between opposite ends of the paper-dust removal member and a second part located between the first centrally located part and at least one of the opposite ends of the paper-dust removal member, the first centrally located part and the second part being arranged along the second direction, and the centrally located first part having a higher contact resistance against the sheet as compared to the contact resistance of the second part against the sheet; and a post processing unit that performs post processing to the sheet.

* * * * *